United States Patent [19]

Wesler et al.

[11] 3,943,747

[45] Mar. 16, 1976

[54] PORTABLE HOT PIPE BENDING APPARATUS

[75] Inventors: Allan B. Wesler, New York; Lyber Katz, Bronx, both of N.Y.

[73] Assignee: Tubeco, Inc., Brooklyn, N.Y.

[22] Filed: Dec. 27, 1973

[21] Appl. No.: 428,750

[52] U.S. Cl. ..... 72/388; 72/455; 72/380; 72/457

[51] Int. Cl.[2] ..... B21D 11/02

[58] Field of Search ..... 72/369, 380, 388, 392, 72/455, 457, 482, 406

[56] References Cited

UNITED STATES PATENTS

| | | | |
|---|---|---|---|
| 2,273,655 | 2/1942 | Olsen | 72/380 |
| 2,347,593 | 4/1944 | Cummings | 72/388 |
| 2,547,870 | 4/1951 | Kelso | 72/380 |
| 2,771,116 | 11/1956 | Ballard | 72/406 X |
| 2,832,394 | 4/1958 | Blagden | 72/389 |
| 2,867,261 | 1/1959 | Traupmann | 72/389 X |
| 3,246,503 | 4/1966 | Williams et al. | 72/455 X |
| 3,456,468 | 7/1969 | Crippen | 72/388 X |

*Primary Examiner*—C. W. Lanham
*Assistant Examiner*—D. M. Gurley
*Attorney, Agent, or Firm*—Hopgood, Calimafde, Kalil, Blaustein & Lieberman

[57] ABSTRACT

The invention contemplates portable apparatus for use in hot-bending of tubular pipe, comprising a rigid triangular frame of connected legs wherein a forming-die platform is located near one corner of the frame, along with a back-up shoe support at the corner, so that pipe-support and bending may commence from said one corner, progressing in the direction of one of the adjacent sides of the frame. The bending forces are provided by a winch mounted on the same platform and utilizing block and tackle that has anchoring reference to one or both of the remaining corners of the frame. In a preferred embodiment, the frame legs which define the platform corner are truncated into halves, whereby the platform and its adjacent leg halves comprise one of two removably securable subassemblies.

10 Claims, 5 Drawing Figures

Fig. 1.
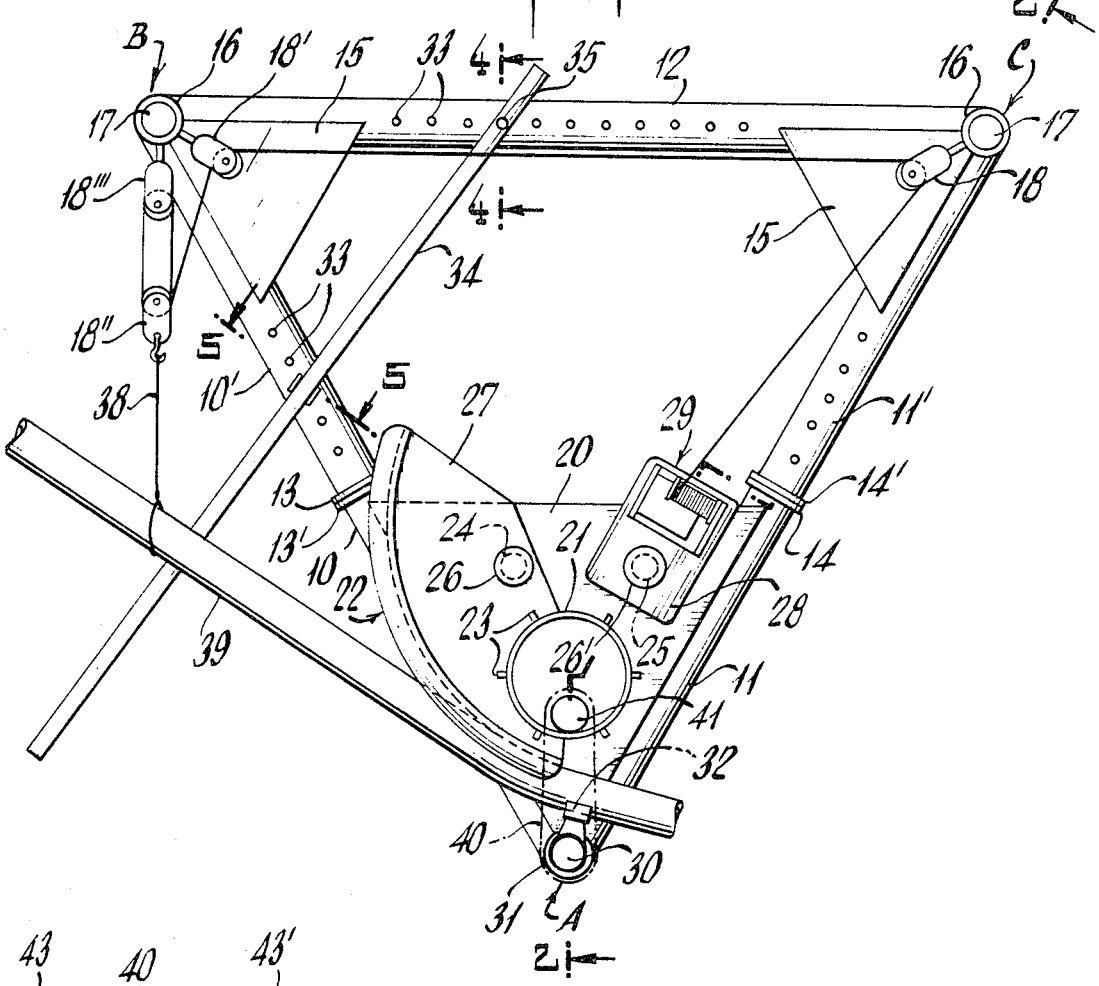
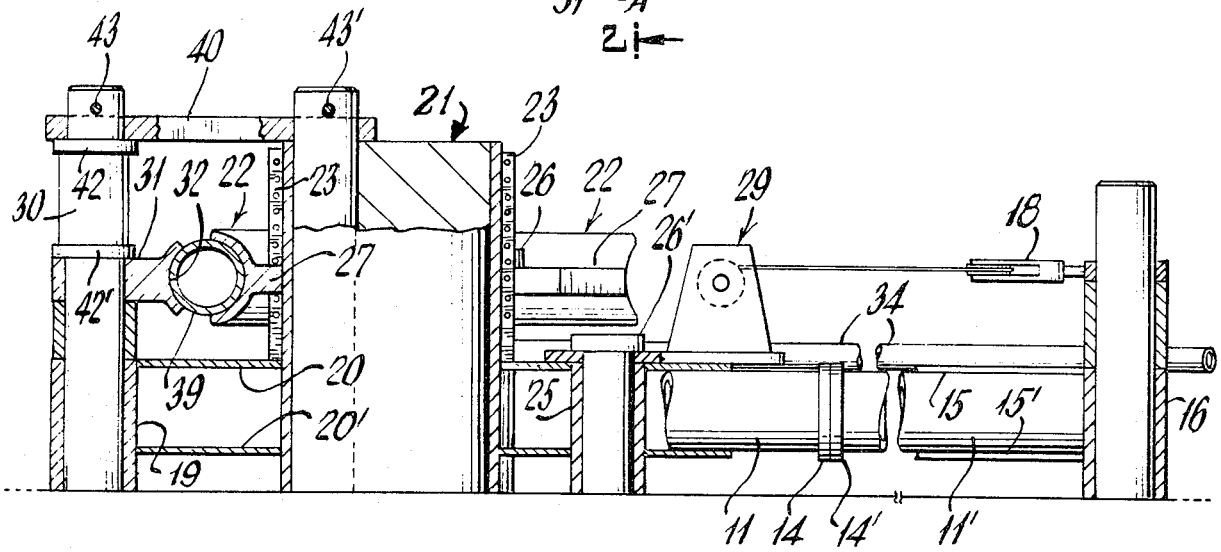
Fig. 2.

Fig.3.
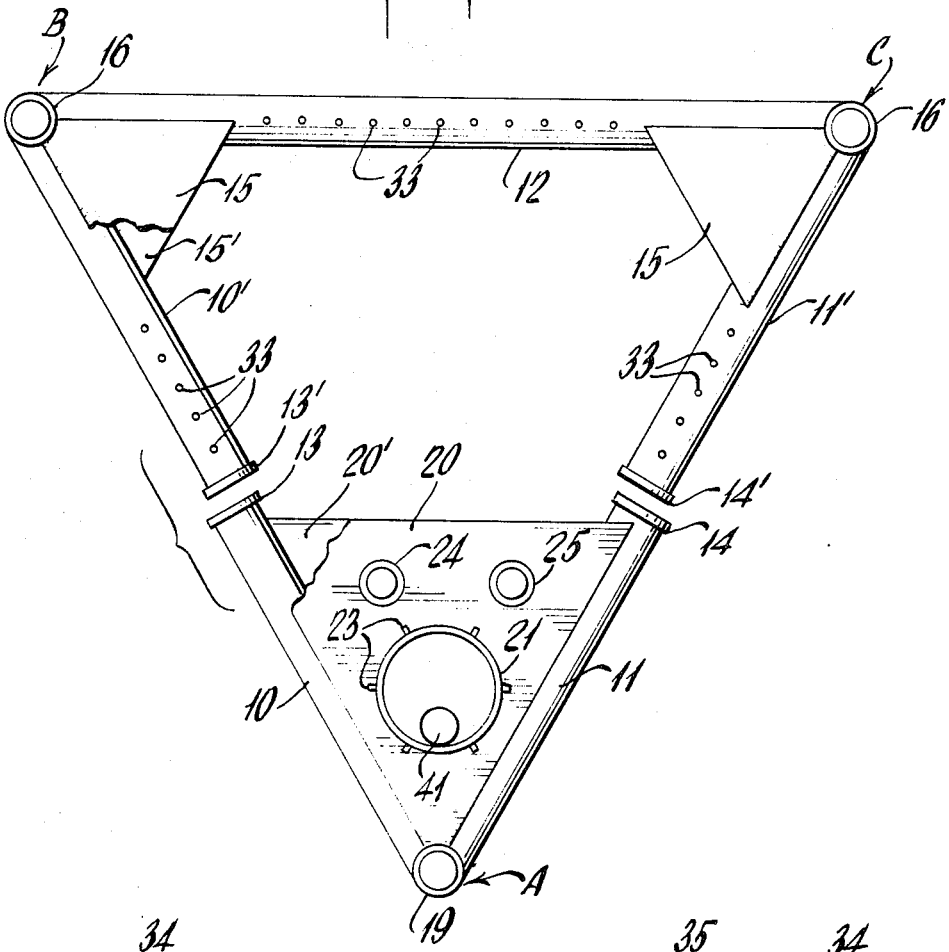
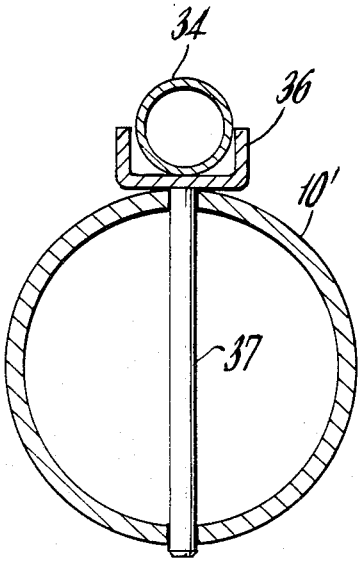
Fig.5.
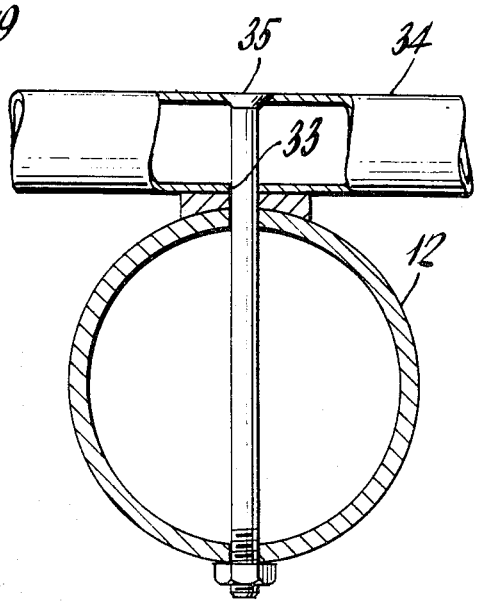
Fig.4

PORTABLE HOT PIPE BENDING APPARATUS

This invention relates to apparatus for the hot-bending of tubular pipe and in particular to portable apparatus capable of handling steel pipe of 4-inch and larger diameters, whereby bending operations may be performed close to the situs of use.

At present, steel pipe of the indicated sizes has had to be bent at a shop wherein the shop floor or other earth-bound reinforcements or references are necessary, to sustain the reaction forces generated in the course of bending the pipe. This fact represents a substantial limitation, with various disadvantages, not the least of which is the high cost of shipping bent pipe, as compared with the cost of shipping straight pipe.

It is accordingly an object of the invention to provide improved pipe-bending apparatus which is portable and which will therefore enable bending operations to be performed close to the point of intended use of the bent pipe.

Another object is to provide such apparatus wherein all pipe-bending forces are efficiently contained within and by a single rigid frame which requires no floor or other earth-bound reference in the generation or application of pipe-bending forces.

A further object is to provide such apparatus in a demountable construction which does not adversely affect the ability to contain pipe-bending forces and which enables shipment of connectable subassemblies rather than a single, permanently rigid structure.

A further specific object is to meet the above objects with a construction which lends itself with relatively flexible adaptability to the accommodation of a range of pipe diameters and lengths, for bending to a range of bending radius and arcuate extent.

Other objects and various further features of novelty and invention will be pointed out or will occur to those skilled in the art from a reading of the following specification, in conjunction with the accompanying drawings. In said drawings which show, for illusrative purposes only, a peferred form of the invention:

FIG. 1 is a plan view of an assembled apparatus of the invention;

FIG. 2 is a sectional view taken generally along the alignment 2—2 of FIG. 1;

FIG. 3 is an exploded plan view of separated subassemblies of the frame of FIG. 1; and FIGS. 4 and 5 are fragmentary sectional views taken at 4—4 and 5—5, respectively, in FIG. 1.

Referring to the drawings, the invention is shown in application to apparatus comprising a rigid triangular frame involving three interconnected tubular steel legs, between corners A–B–C. As will later be pointed out, these legs are distributed between separably connected subassemblies, wherein two adjacent legs of the frame each involve separably connected half legs. Thus, a first leg and a second leg are formed as separable halves 10–10′ and 11–11′, and the third leg 12 is rigidly connected at each end to the adjacent half legs 10′–11′. Various techniques may be employed for separable connection of the half legs 10–10′ and 11–11′, but we indicate preference for use of bolted flanges. As shown, therefore, flages 13—13′ on the respective adjacent ends of leg halves 10–10′ are abutted and bolted to assemble one of the frame legs, while similar flanges 14–14′ on the respective adjacent ends of leg halves 11–11′ are abutted and bolted to assemble the remaining frame leg.

The subassembly comprising leg 12 and the adjacent leg halves 10′–11′ is rendered rigid by triangular corner gussets 15, detail of which best appears in FIG. 3. Each gusset is shown as a triangular plate, seated tangent to its adjacent leg portions and welded to the outer surface of these leg portions; preferably, like upper and lower gusset plates are used, and at corner B, a part of the upper gusset plate 15 has been broken-away to reveal at 15′ the corresponding lower gusset plate. The corners B–C are alike, each comprising an upstanding tubular member or sleeve 16 to which adjacent leg ends and gusset-plate corners are fitted and permanently secured by welding. Pins 17 are removably received in the corner sleeves 16, being formed to project upwardly above the plane of the frame for purposes of anchoring corner pulley blocks 18–18′ of a block-and-tackle system to be more fully described. The subassembly of corners B and C is thus seen to be rigid, permanent and unit-handling, placing the flanges 13′–14′ correctly for detachable assembly to flanges 13–14.

The other subassembly is triangular, involving corner A and the adjacent leg halves 10–11. The subassembly includes an upstanding tubular member or sleeve 19 at corner A, and like upper and lower triangular brace plates 20–20′ seated and welded tangent to the leg halves 10–11 for the full effective length thereof. Plates 20–20′ and leg halves 10–11 thus define a platform for selective mountig of bending tools appropriate to the pipe size and bending arc desired for a particular operation.

As shown, plural openings at corresponding locations in the plates 20–20′ serve for such mounting. An upstanding tubular stanchion 21 extends through a first pair of such openings, being peripherally welded to both plates 20–20′ at said openings. Stanchion 21 projects above the plane of the frame and serves as a basic reference for a forming die 22; it is preferably internally reinforced, by means not shown, and includes external upstanding ribs 23 by which it may have keyed engagement to the web or hub of the selected forming die 22. At further pairs of corresponding openings in plates 20–20′ upstanding sleeves 24–25 are received and welded; as shown, sleeve 24 provides location for a pin 26 through the web plate 27 of die 22, and sleeve 25 provides location for a pin 26′ through the base plate 28 of a winch unit 29. Stanchion 21 is firmly located in the crotch between leg halves 10–11, and sleeves 24–25 are offset therefrom, being symmetrically placed with respect to the vertical plane which extends through corner A and bisects the plates 20–20′. This symmetrical layout permits placement of die 22 to the left of this plane of symmetry, with the winch unit 29 to the right of the same plane; alternatively, the positions of the die and winch may be reversed, as may be dictated by certain bending requirements.

The A-corner sleeve 19 removably accommodates an upstanding pin 30 for pivotal support of a back-up shoe 31, concaved at 32 as appropriate for the diameter of the pipe to be bent.

Description of the basic structure is completed by identifying spaced openings 33 along leg 12 and leg halves 10′–11′, whereby a pipe-support rail or rails 34 may be positioned to maintain the correct plane of support of the free end of a pipe length during the course of a bend. As shown, a countersunk bolt 35 near one end of rail 34 passes through one of the openings 33 in leg 12, being secured in place to maintain the cantilevered horizontal orientation of the other end of rail 34 (see FIG. 4). At intersection with leg half 10', rail 34 is slidably guided between short upstanding arms of a member 36 having a pivot stem 37 insertably received in a selected one of the openings 33 of leg half 10' (see FIG. 5).

Typically, apparatus of the character indicated, for hot bending of steel pipe up to 18 or 24-inches diameter, or more, comprises an isosceles frame wherein the tubular leg material is of 9-inches diameter, leg 12 being 18-feet long, and each half leg being 10-feet long. Both subassemblies may thus be transported within 9-foot limits on a flat-bed trailer, with ample room to accommodate all necessary forming dies 22 and other accessories 18–29–30–34 and the like. All upstanding sleeves 16–19–24–25 and stanchion 21 may project to the same extent below the plane of lower plates 15'–20' to enable level reference to a given floor slab, without resting upon any of the flanges 13–13'–14–14'. Assembly is a simple matter of bolting these flanges, and selecting and mounting the necessary forming die 22 and back-up shoe 31, with vertical offset as appropriate for the plane of pipe support afforded by rail 34. Winch unit 29 pivots as necessary on its pinned connection to sleeve 25, and its cable is trained over blocks 18–18'–1-8''– 18''' to establish the desired elevation and direction of chain or cable pull at 38 to the free end of the pipe 39 to be bent.

The pipe 39 to be bent is first filled with sand and the ends capped, before heating in the region to be bent. One end is then inserted between shoe 31 and the adjacent end of die 22, the other end being supported on one or more rails 34, and the chain or cable connection 38 is then made to the block-and-tackle connection to winch 29. As winch 29 takes up the cable, the heated section of pipe 39 yields and is conformed to the bending arc of die 22. The forces reacting on the triangular frame are essentially and primarily compressional and are fully contained within the frame, and the efficiency of containment of these forces is such that the pipe 39 to be bent may be substantially larger than the pipe size used as legs 10–11–12 of the basic frame. Dismounting and disassembly are a simple matter, for ready transport to a succeeding job location.

The drawings additionally illustrate a preferred feature which avoids reaction between cantilevered posts at the region of primary bend-reaction forces; namely, a removable connection 40 between stanchion 21 and the back-up post 30, located above th elevation of die 22 and shoe 31. As shown, connection 40 is a rugged strap or plate apertured at its ends for removable application to the upper end of post 30 and to the upper end of an upstanding post 41 contained within and forming part of the internal reinforcement of stanchion 21; connection 40 is shown in phantom outline in FIG. 1, for a better showing of other parts. Shoulders or spacers 42–42' on pin 30 establish a correct plane of support of connecting plate 40, and removable pins 43–43' secure the connected relationship during a bending operation.

The invention will be seen to achieve all stated objects, providing field-use capabilities hitherto unavailable. Great savings may be realized in pipe-transportation cost, and the bent pipe may be quickly integrated into its final installation.

While the invention has been described in detail for the preferred form shown, it will be understood that modifications may be made without departure from the claimed invention. For example, the configuration of the forming die and the specific manner of its retention upon the platform assembly 10–11–20–20' may vary as convenient, as may also the particular disposition of the means 24–25 by which the winch unit 29 is secured to the platform assembly. Also, the block and tackle configuration may be as desired for particular applications, the specific arrangement being illustrative of the use of both corner references, at B and C.

Still further, it will be understood that reference to parts 10–10' and 11–11' as half legs is purely illustrative of a demountable structure. The use of two leg parts of equal length is by no means a requirement, in that other length proportions for the parts and other numbers of parts may be indicated for particular usages. Also it will be understood that the particular described rigid formations of the subassembly for corners B and C is not a limitation, in that, for example, an articulated connection or a telescoped assembly of leg parts 10'–11'–12 at corners B and C is an acceptable arrangement for certain applications, as long as care is taken to ensure the relatively rigid integrity of the pipe-mounting corner (A) and its associated die and shoe retaining structure.

What is claimed is:

1. Transportable apparatus for the hot-bending of relatively large tubular pipe, comprising an assembled generally triangular rigid frame of three tubular-pipe legs, said frame consisting of at least two subassemblies having detachable interconnection means; one of said subassemblies comprising a rigid triangle of adjacent tubular-pipe parts of two of said legs, with upper and lower triangular plates secured along corresponding edges to and spaced by said adjacent tubular-pipe parts, die-supporting stanchion means upstanding from the upper plate and secured to both plates, an arcuate forming die removably mounted to said stanchion means adjacent the upper plate, the orientation of said die being such that the bending arc of said die is convex outward and overstands one to the exclusion of the other of said adjacent leg parts, a winch and means for removably mounting the same on said upper plate at a location offset from said die in the direction of the other of said leg parts, and a back-up shoe and means for removably mounting the same at the apex of said one subassembly; the other of said subassemblies including the third tubular-pipe leg joined at its ends to the remaining tubular pipe parts of said two legs, and said detachable interconnection means connecting adjacent corresponding ends of said tubular-pipe leg parts; and block-and-tackle means including pulleys removably connected at substantially the ends of said third leg and including a line connection to said winch.

2. Apparatus according to claim 1, in which said plates have aligned openings near the juncture of said two adjacent tubular-pipe parts of said rigid triangle and in which said stanchion means for removably mounting the forming die comprises an upstanding tubular member passing through said openings and secured to both plates.

3. Apparatus according to claim 1, in which said plates have plural corresponding aligned openings on spaced alignments and in which said means for removably retaining the forming die comprises a plurality of upstanding tubular members each of which passes through corresponding openings of both plates and is secured to both plates.

4. Apparatus according to claim 1, in which said detachable connection means comprises flanges on adjacent ends of adjacent leg parts, and means for detachably connecting said flanges.

5. Apparatus according to claim 1, in which said shoe-mounting means comprises a tubular sleeve secured at said apex in an orientation normal to said plates, and an upstanding shoe pivot pin engaged to said sleeve.

6. Apparatus according to claim 5, and including detachable means interconnecting said shoe pivot pin and said die-mounting means above the elevation of said die.

7. Apparatus according to claim 1, in which the other subassembly includes gusset plates secured to and between said third leg and the adjacent leg parts connected thereto.

8. Apparatus according to claim 1, in which the removable connections of said block and tackle means comprises at each end of said third leg a tubular sleeve secured to adjacent legs in an orientation normal to the general plane of said legs, and an upstanding pin engaged in each sleeve.

9. Apparatus according to claim 1, in which the detachable interconnection of leg parts are at substantially half-length points of said two legs.

10. Apparatus for the hot-bending of tubular pipe, comprising a generally triangular rigid frame of three interconnected elongate tubular-pipe legs, a die-mounting platform comprising upper and lower triangular plates secured along corresponding edges to and spaced by adjacent legs at one corner of the frame triangle, a back-up shoe and means for removably mounting the same at said one corner and upward of said platform, die-supporting stanchion means upstanding from the upper plate and secured to both plates, an arcuate forming die removably mounted to said stanchion means adjacent the upper plate, the orientation of said die being such that the bending arc of the die is convex outward and overstands one to the exclusion of the other of said adjacent legs, a winch and means for removably mounting and retaining the same on said platform at a location offset from the retained die and in the direction of the other of said adjacent legs, and block-and-tackle means including block-anchoring means at each of the remaining corners of said frame and including a line connection to said winch.

* * * * *